United States Patent [19]

Ternan et al.

[11] 4,176,051

[45] Nov. 27, 1979

[54] PROCESS FOR CATALYTICALLY HYDROCRACKING A HEAVY HYDROCARBON OIL

[75] Inventors: Marten Ternan; Basil I. Parsons, both of Ottawa, Canada

[73] Assignee: Her Majesty the Queen in right of Canada, as represented by the Minister of Energy, Mines and Resources, Ottawa, Canada

[21] Appl. No.: 959,256

[22] Filed: Nov. 9, 1978

[30] Foreign Application Priority Data

Nov. 18, 1977 [CA] Canada ..... 291229

[51] Int. Cl.[2] ..... C10G 13/02; C10G 23/02; B01J 35/02

[52] U.S. Cl. ..... 208/112; 208/10; 252/447; 252/477 R; C10G/1/06

[58] Field of Search ..... 208/112, 10

[56] References Cited

U.S. PATENT DOCUMENTS

| | | | |
|---|---|---|---|
| 3,617,481 | 11/1971 | Voorhies et al. | 208/50 |
| 3,692,858 | 9/1972 | Brewer et al. | 208/89 X |
| 3,715,303 | 2/1973 | Wennerberg et al. | 208/112 |
| 4,054,504 | 10/1977 | Chervenak et al. | 208/10 |

*Primary Examiner*—Delbert E. Gantz
*Assistant Examiner*—G. E. Schmitkons

[57] ABSTRACT

A process for catalytically hydrocracking a heavy hydrocarbon oil containing at least 25 weight percent of hydrocarbon substances which will boil at a temperature of at least 524° C. and contain coke forming hydrocarbon substances and which may contain hydrocarbon substances with metal present are hydrocracked in a continuous process. The heavy hydrocarbon oil is first slurried at 50° C. to 400° C. with a particulate catalyst mass comprising aluminum compound coated coal and/or coke particles which may also be coated with a cobalt and/or a molybdenum compound, the slurry is heated to 250° C. to 550° C. and continuously fed to the bottom of a catalytic hydrocracking vessel to pass upwardly therethrough at a pressure in the range 100 to 3,500 psig and a temperature in the range 400° C. to 500° C. The process avoids coking of the reactor vessel and being continuous replaces the catalyst mass before excessive deposits of coke or metals occurs thereon. While cobalt and nickel compounds are preferred, any compounds of metals of Groups VI (b) or VIII of the Periodic Table may be used.

7 Claims, 9 Drawing Figures

PROCESS FOR CATALYTICALLY HYDROCRACKING A HEAVY HYDROCARBON OIL

Figure 1:
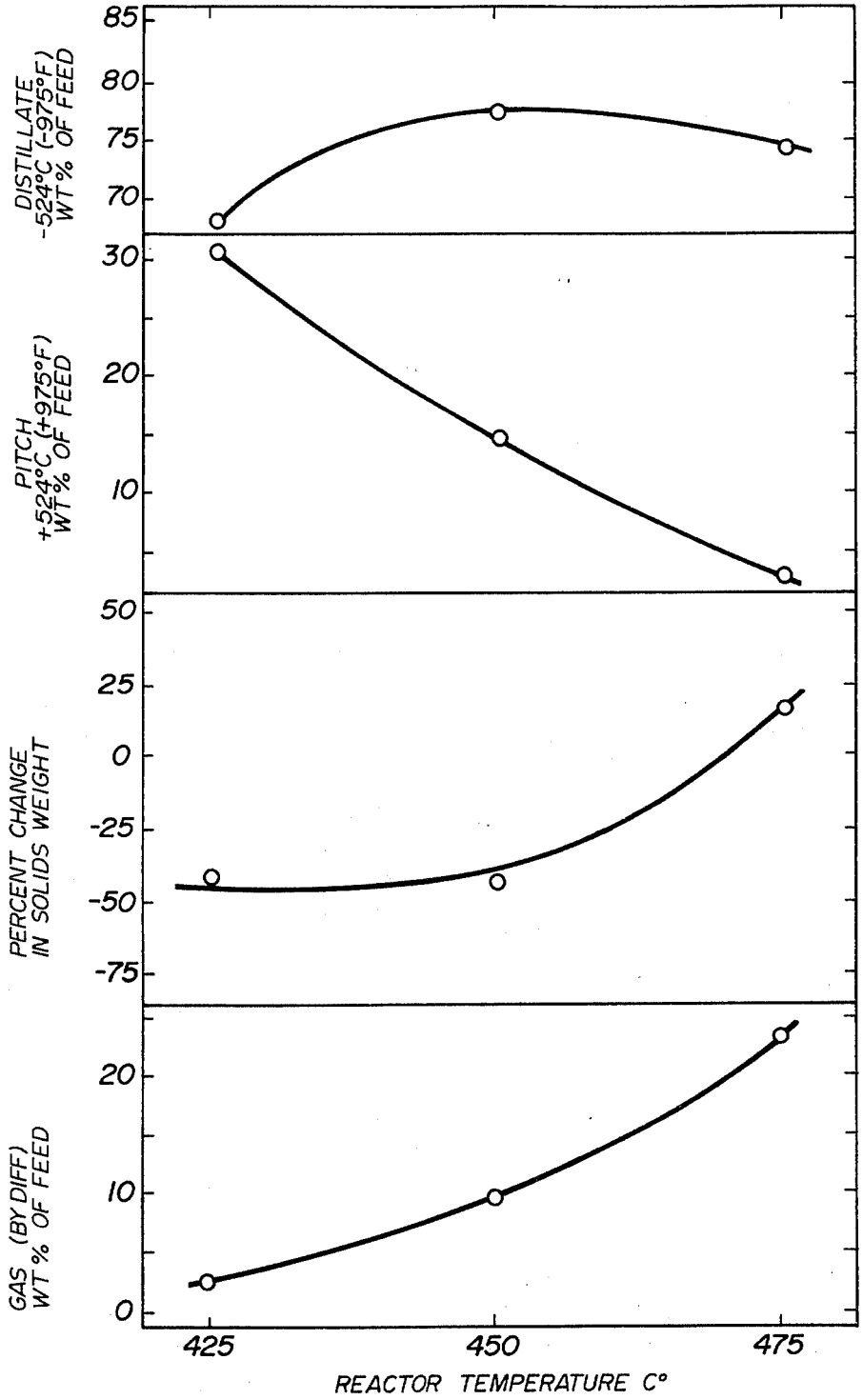

This invention relates to a process for catalytically hydrocracking a heavy hydrocarbon oil.

In this specification a heavy hydrocarbon oil means and oil containing at least 25 weight percent of hydrocarbon substances which will boil at a temperature of at least 524° C., at least a portion of the hydrocarbon substances which will boil at a temperature of at least 524° C. containing hydrocarbon compounds which are coke forming and at least a portion of the hydrocarbon substances which boil at a temperature of at least 524° C. may contain metal or metals.

Examples of heavy hydrocarbon oils are heavy crude oils, petroleum residua, bitumens from oil sand deposits and organic material from oil shale.

As the supply of light crude oils having low sulphur contents decreases, it becomes necessary to begin using some of the heavy crude oils. The first step in utilizing heavy crude oils involves the conversion of the high boiling hydrocarbon substances into lower boiling distillates which can be processed to obtain conventional fuel products such as gasoline or home heating fuel.

In the case of bitumen from oil sand deposits, this type of conversion has been accomplished by coking processes. The major disadvantage of coking processes is that they produce a large yield of coke by-product. The coke yield is approximately 22 weight percent when a delayed coking process is used for conversion of bitumen from the Athabasca Oil Sands deposits. This coke has a high sulphur content (as high as 6 wt %) which makes it unsuitable as a boiler fuel, in view of current air pollution regulations. In addition the coke contains large amounts of nickel, vanadium and iron metals. Since no uses for this material have been found to date current commercial practise consists of stock piling the coke. From a conservation standpoint it would be preferably if some useful material were formed instead of the coke.

In many instances catalytic hydrocracking processes are superior to coking processes in that they do not produce any bulk quantities of a coke by-product and all of the products produced are pumpable liquids. As a result hydrocracking processes generally produce a much higher conversion to useable liquid products than coking processes. Hydrocracking processes have been used frequently on an industrial scale with great success when distillates such as light gas oil or heavy gas oil are the feedstocks.

However when the feedstocks are heavy hydrocarbon oils, the catalytic hydrocracking processes have not been generally successful. In the case of catalytic hydrocracking heavy hydrocarbon oils containing coke forming hydrocarbon substances which boil at a temperature of at least 524° C., the amount of coke that is formed is virtually negligible. However this minute amount of coke that is formed is sufficient to foul the active sites on the catalyst and cause a rapid decline in the activity of the catalyst. Furthermore, when metals are also present in hydrocarbon substances which boil at a temperature of at least 524° C., these metals also foul the catalyst and cause a decline in the catalytic activity.

Thus there is one special circumstance in which a catalytic hydrocracking process can be used for the conversion of oils containing hydrocarbon substances which boil at a temperature of at least 524° C., and this is when the oils contain small amounts of coke precursors, metals, and asphaltenes, specifically less than 10 weight percent asphaltenes. A few commercial catalytic hydrocracking plants operating in either the fixed bed or fluidized bed modes have been constructed to process special oils of this type. However, many available heavy hydrocarbon oils, such as the bitumens from oil sand deposits, contain large concentrations of metals and coke precursors and these heavy hydrocarbon oils cannot be processed using conventional catalytic hydrocracking methods.

The useful catalyst lifetime achieved with distillate feedstocks such as light gas oil and heavy gas oil vary from 6 months to several years. In contrast the useful catalyst life times typical of heavy hydrocarbon oils are a few hundred hours and sometimes much less. This means that in the case of heavy hydrocarbon oils the cost of the frequent replacement of spent fouled catalyst with fresh catalyst is economically prohibitive. This is one of the primary reasons why coking processes have been used on a commercial scale for upgrading bitumens obtained from oil sands deposits instead of hydrocracking processes using catalysts.

There are at least two approaches to this problem. The first would be to formulate catalysts from materials which would prevent the minute amount of coke formation from the heavy hydrocarbon oils. If the materials were sufficiently effective and the catalyst lifetime sufficiently long, the processing cost per unit volume of heavy hydrocarbon oil could be quite low, even if costly materials were used in the catalyst formulation. The second approach would be to use extremely inexpensive materials in the catalyst formulation. If the catalyst cost was sufficiently low, the effective catalyst lifetime could be quite short and the processing cost per unit volume of heavy hydrocarbon oil would again be quite low.

The present invention is concerned with the second approach described above to the problem when catalytically hydrocracking a heavy hydrocarbon oil in that the composition of the catalyst is such that its final cost is sufficiently low that it can be removed from the reaction system after relatively short times without being economically prohibitive. Thus the combination of inexpensive catalyst composition and short catalyst lifetime permits the processing cost per unit volume of the heavy hydrocarbon oil to be acceptable.

According to the present invention there is provided a process for catalytically hydrocracking a heavy hydrocarbon oil, comprising:

(a) heating the hevy hydrocarbon oil to a temperature in the range 50° C. to 400° C., then (b) mixing the heavy hydrocarbon oil, while at the temperature in the range 50° C. to 400° C., with a particulate catalyst mass to form a slurry, the particulate catalyst mass being in the range 0.1 to 10 weight percent of the slurry and comprising discrete catalyst supports of at least one material selected from the group consisting of coal and coke with each catalyst support coated with a catalytically active aluminum compound and at least one catalytically active material selected from the group consisting of compounds of metals of Group VI (b) and Group VIII of the Periodic Table of Elements, (c) mixing the slurry with hydrogen gas and heating the mixture to a temperature in the range 250° C. to 550° C., then (d) continuously feeding the mixture while at the temperature in the range 250° C. to 550° C. to a lower end portion of a catalytic hydrocracking reactor vessel, (e) causing the mixture to flow upwardly in the reactor vessel at a pressure in the range 100 to 3,500 psig and at a temperature in the range 400° C. to 500° C. so that gaseous and vapour phases components liberated from the mixture in the reactor vessel rise rapidly therein and separate from residual liquid phase and entrained particulate solids components which flow slowly upwardly therein, and (f) continuously withdrawing the gaseous and vapour phase components and the liquid phase with entrained particulate solids from an upper portion of the reactor vessel.

Figure 3:
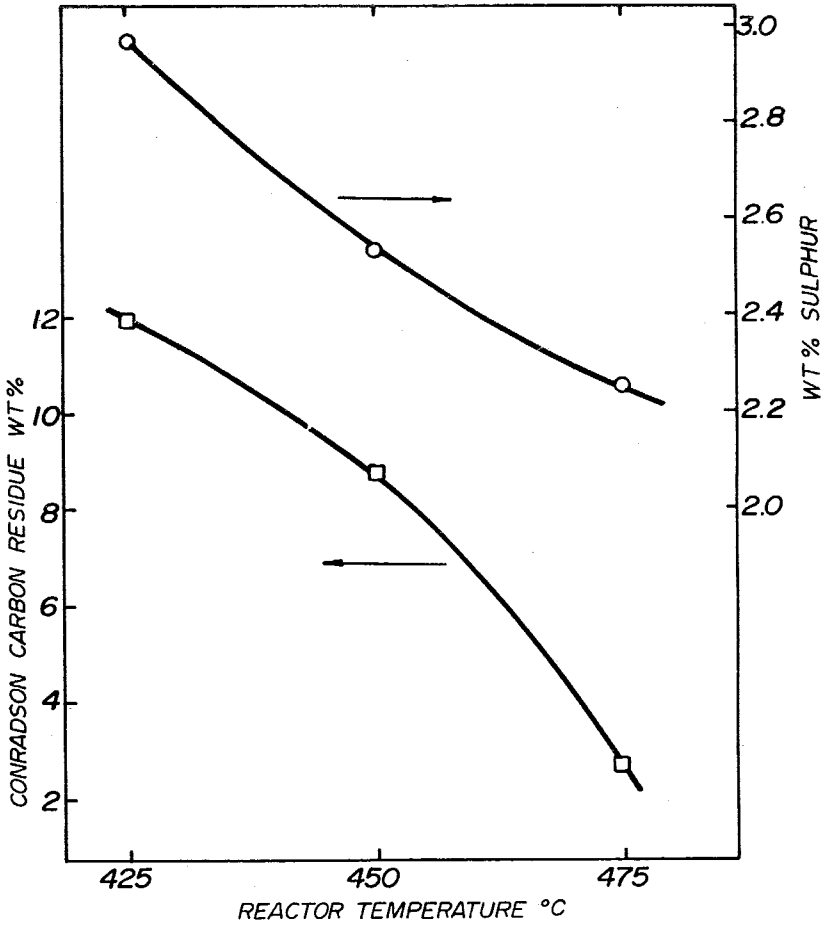
Figure 2:
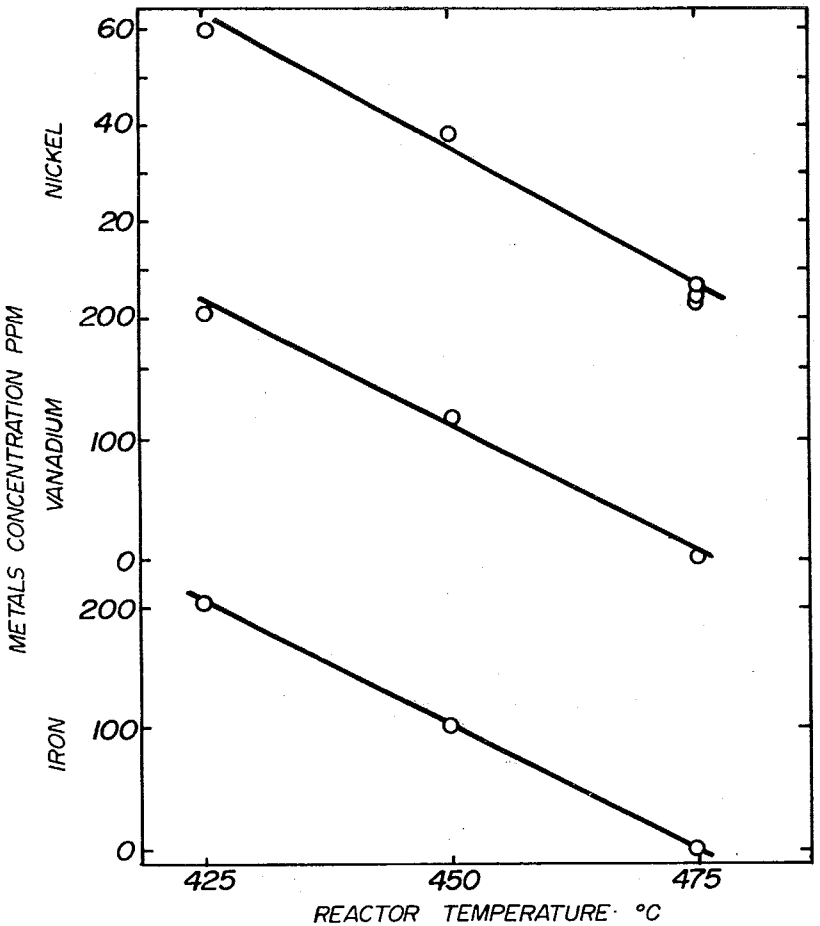
Figure 4:
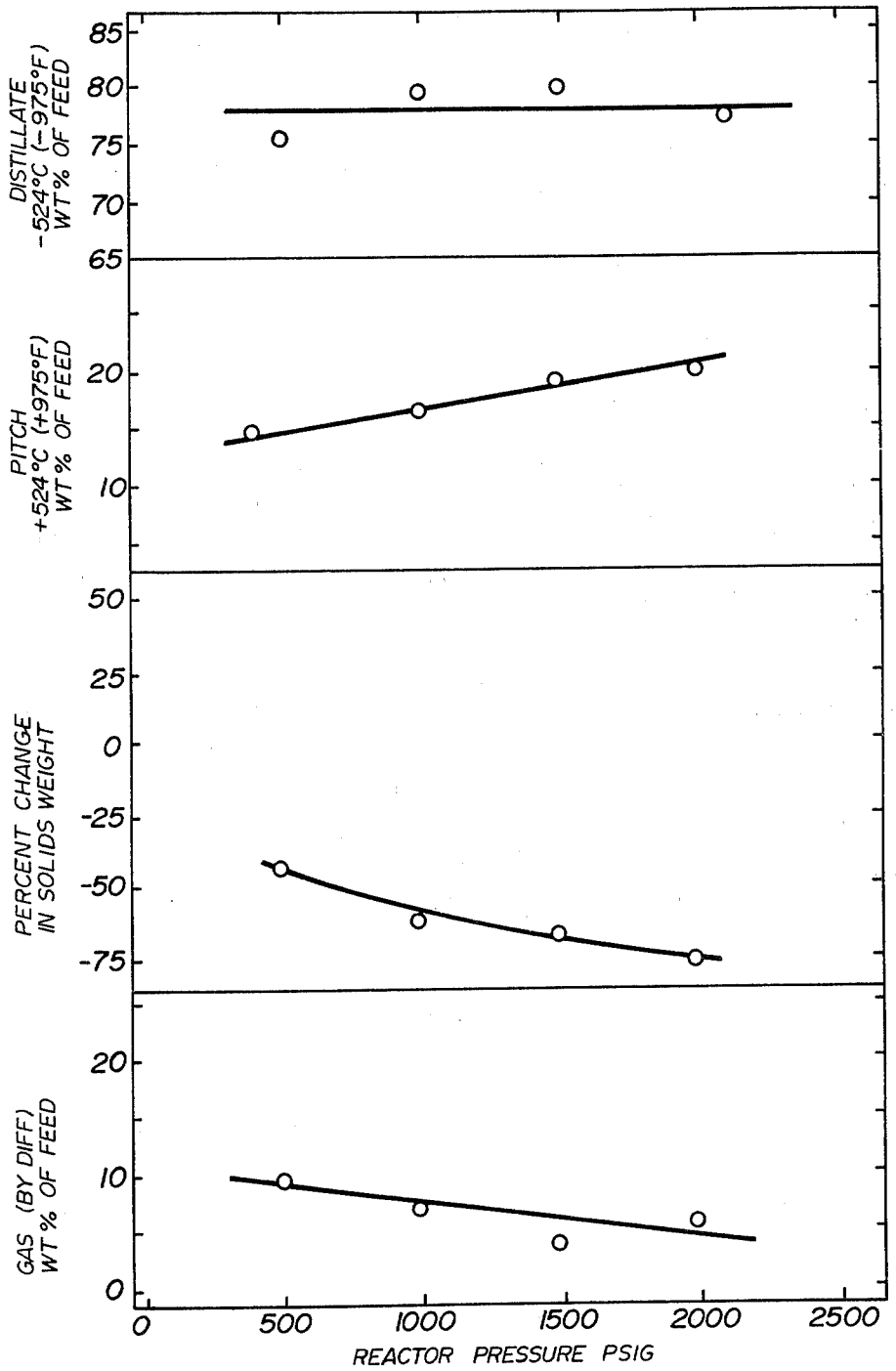
Figure 6:
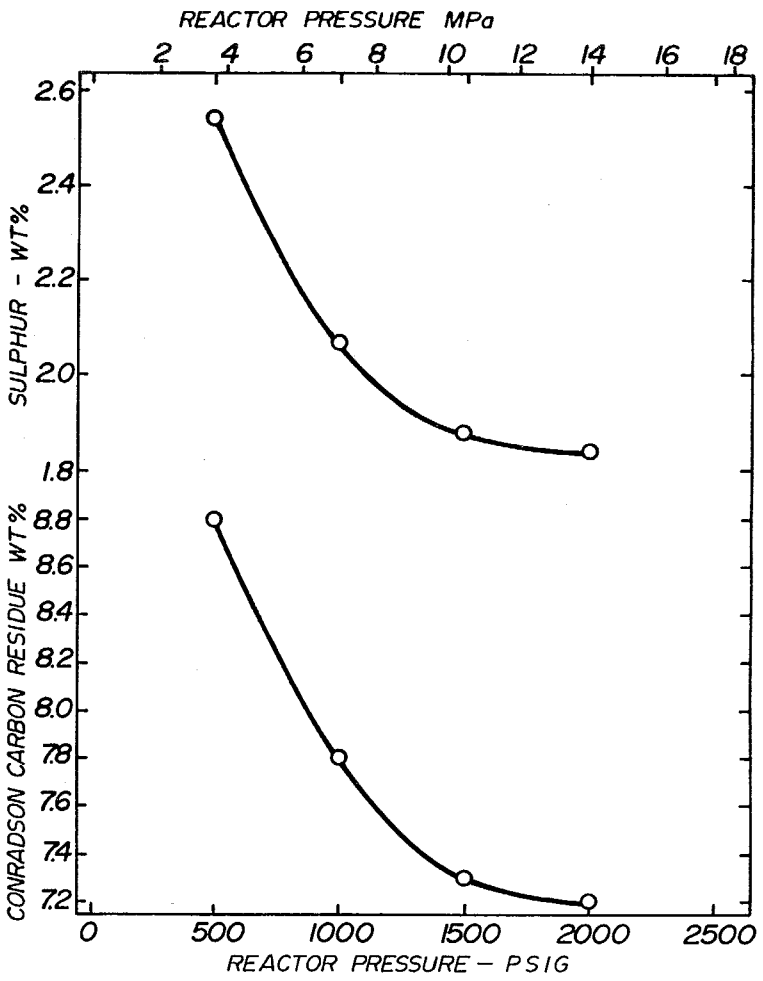
Figure 5:
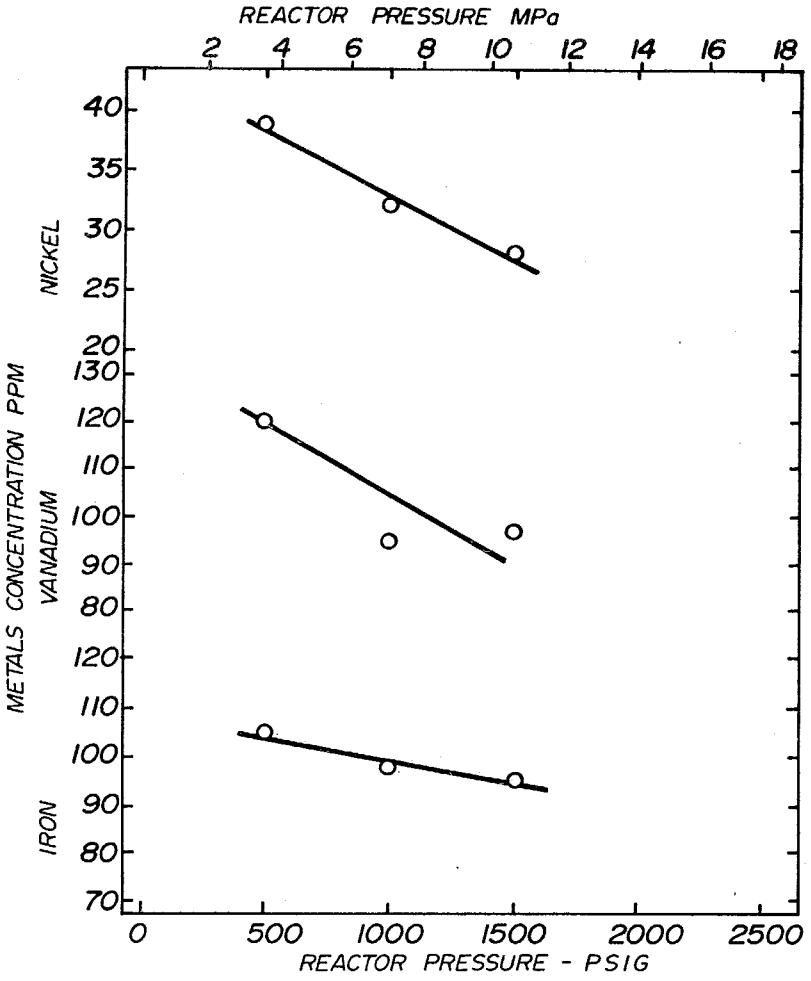
Figure 7:
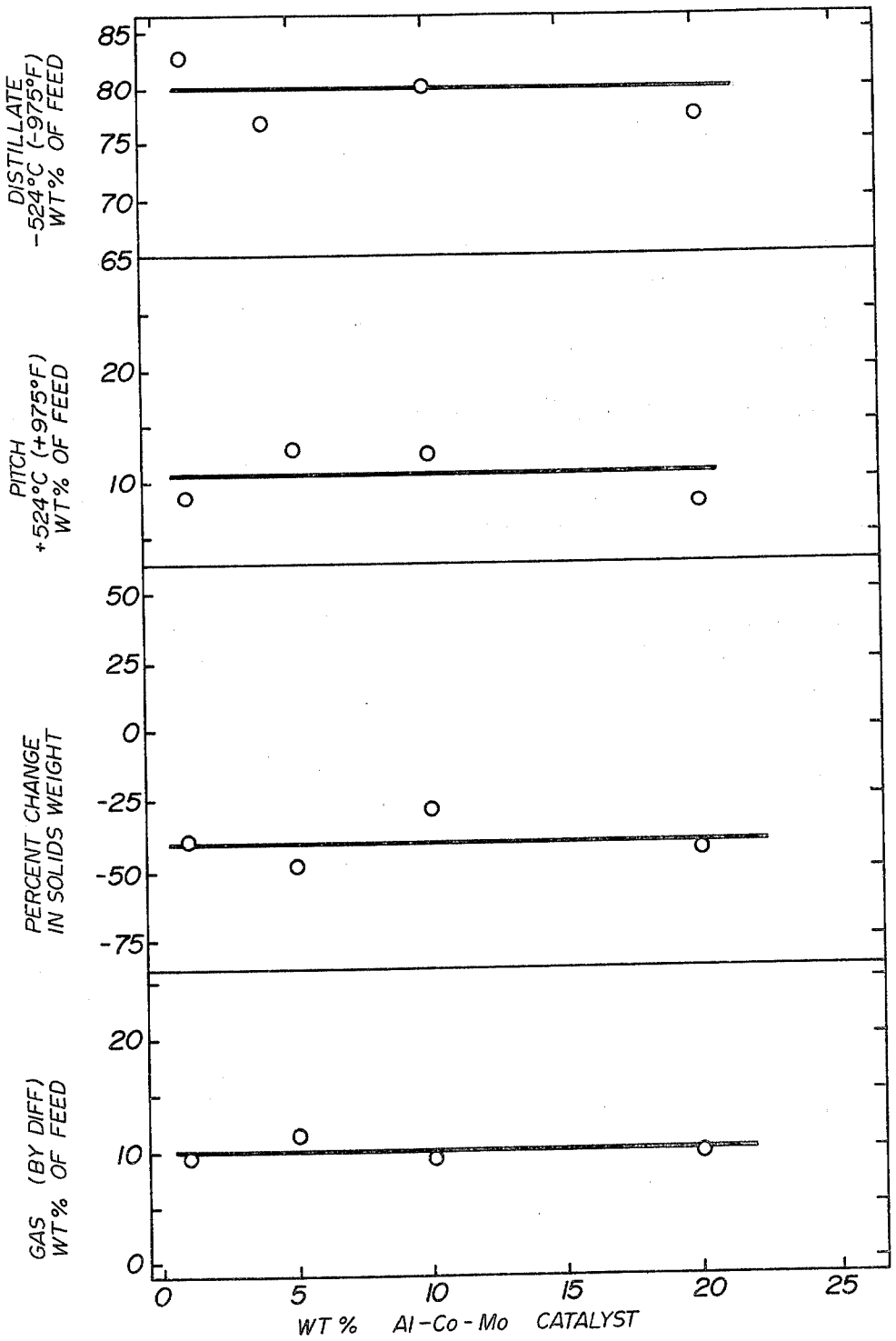
Figure 9:
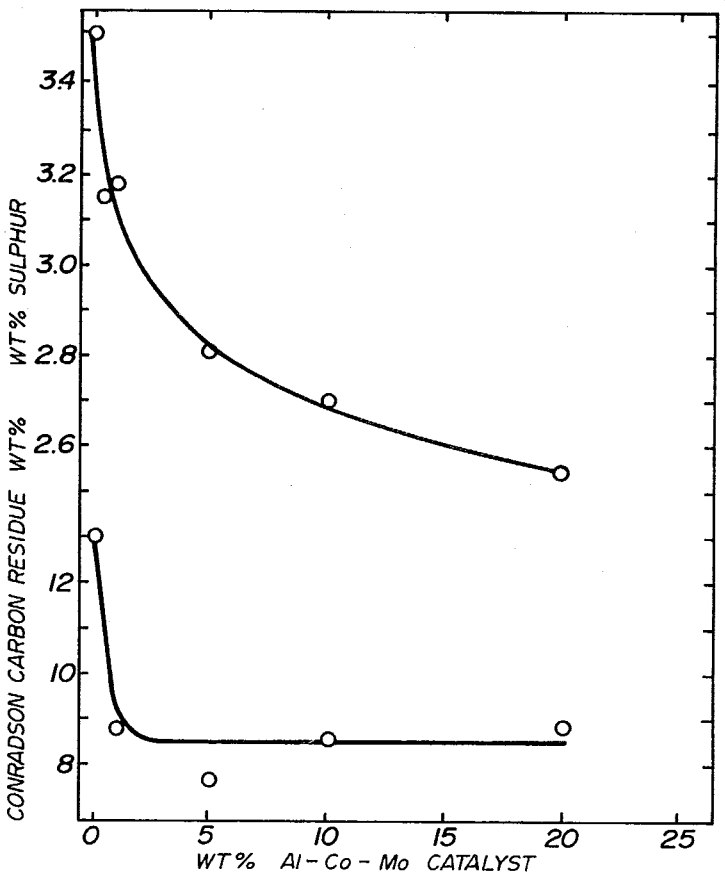
Figure 8:
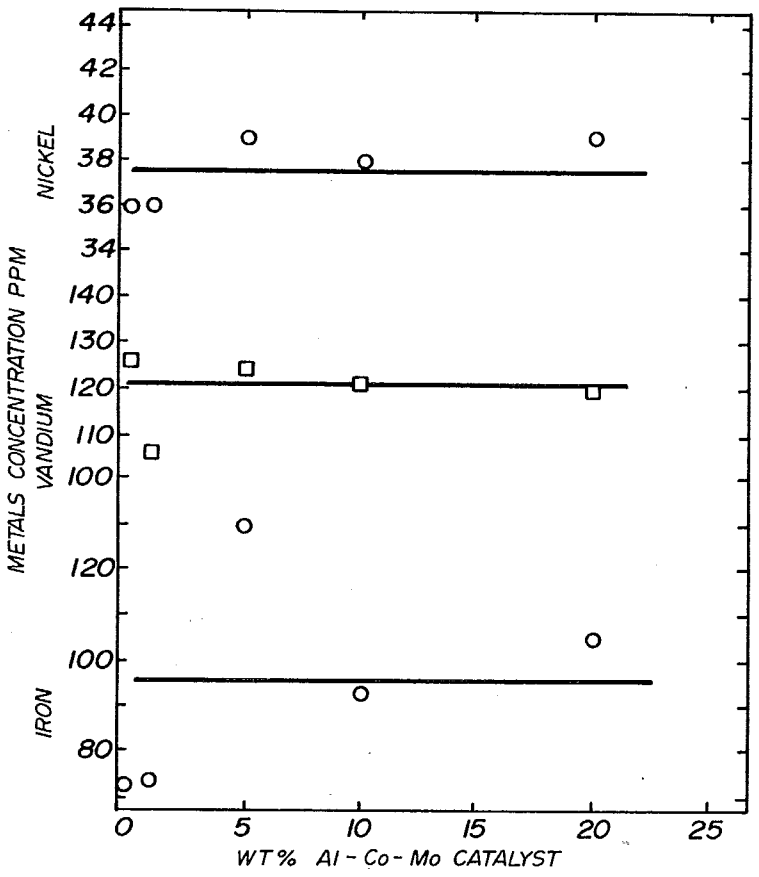

In the accompanying drawings which illustrate, by way of example, the results of tests carried out to verify the present invention, FIG. 1 is a graph showing variations in the quantity and quality of products obtained as a function of reactor temperature when catalytically hydrocracking bitumen from tar sands using a fixed bed, FIG. 2 is a similar graph to FIG. 1 but showing variations in the quantity of metals present in the liquid product as a function of reactor temperature, FIG. 3 is a similar graph to FIG. 1 but showing that the quantity of Conradson Carbon Residue present in the liquid product is a function of the reactor temperature, FIG. 4 is a graph showing the effect of reactor pressure on the product yields when catalytically hydrocracking bitumen from tar sands using a fixed bed, FIG. 5 is a similar graph to FIG. 4 but showing the effect of the reactor pressure on the amount of metals present in the liquid product, FIG. 6 is a similar graph to FIG. 4 but showing the effect of the reactor pressure on the Conradson Carbon Residue present in the liquid product, FIG. 7 is a graph showing variations in the quantity and quality of products obtained as a function of weight percent of catalyst present on the total weight of catalyst and a sub-bituminous coal support therefor when catalytically hydrocracking bitumen from tar stands using a fixed bed, FIG. 8 is a similar graph to FIG. 7 but showing variations in the quantity of metals present in the liquid product as a function of the weight percent of catalyst, and FIG. 9 is a similar graph to FIG. 7 but showing the effect of the weight percent of catalyst on the Conradson Carbon Residue present in the liquid product.

The following description outlines a general operating condition of a process according to the present invention:

(a) The feedstock, heavy crude oil, petroleum residua, or bitumen is heated to 50° to 400° C., preferably 75° to 125° C., and mixed with a particulate mass comprising particles of a catalyst to be described later.

(b) The resulting slurry is pumped through heated lines and mixed with hydrogen gas. The resulting mixture is heated further to temperatures of 250° to 550° C. but preferably 375° to 475° C.

(c) The heated slurry then enters the bottom of a catalytic hydrocracking reactor vessel which is maintained at pressures of 100 to 3500 psig, preferably 500 to 2000 psig, and temperatures of 400° to 500° C. and preferably 425° to 475° C.

(d) The components which are in the gaseous or vapour state at the reaction conditions rise quickly and leave the reactor vessel through the top thereof.

(e) The components in the liquid phase flow more slowly upward through the reactor vessel carrying with them the entrained solid phase catalyst particles.

After the hydrocarbon material leaves the top of the reactor vessel the hydrogen can be separated and recycled after some of the gases such as hydrogen sulphide and light hydrocarbon vapours have been removed.

After suitable further processing to ensure that the liquid product is completely compatible, one option would be to place it into a pipeline for shipment to another location for additional processing. Alternatively, the liquid product could flow through a series of drums and then be fed into a fractionating column which would separate the product into various fractions. The liquid fractions could be hydrotreated separately or together in order to meet the desired specifications. The highest boiling fraction from the fractionation column, pitch, would contain the entrained solid catalyst particles from the reactor vessel. This stream could subsequently be burned in a boiler to produce the energy required for the processing sequence, provided stack gas scrubbing facilities were provided for sulphur dioxide removal. Alternatively the pitch and solids could be gasified to produce a mixture of CO and $H_2$ which could be used as feed to provide processing energy.

The discrete catalyst supports are coal particles and/or coke particles. For example petroleum coke manufactured by the delayed coking or the fluid coking processes could be used to provide the coke particles. The exterior surface of the discrete catalyst supports are covered with catalytically active material comprising a mixture containing aluminum, cobalt and molybdenum compounds.

In tests to verify the present invention, a mixture of catalytically active ingredients was prepared. The mixture was composed of alpha alumina monohydrate (boehmite), ammonium paramolybdate, cobalt nitrate and water. The cobalt and molybdenum salts were dissolved in separate quantities of water and then the three components were mixed to eventually form a gel. It was found by experiment that the composition of the gel, expressed in the oxide form, could vary from 1 to 11 weight percent CoO, preferably 3 to 9 weight percent CoO, 4 to 18 weight percent $MoO_3$, preferably 9 to 15 weight percent, 71 to 96 weight percent $Al_2O_3$, preferably 76 to 93 weight percent $Al_2O_3$. The gel was subsequently mixed with an additional quantity of water and the discrete catalyst supports. The mixture was then heated while being stirred continuously, until the excess liquid had evaporated. The particles were then dried at 120° C. The role of the $Al_2O_3$ was to provide acid sites to catalyze the cracking reaction, which is responsible for molecular weight reduction. The cobalt and molybdenum compounds were provided to assist in hydrogenation and desulphurization reaction.

The quantity of the catalytically active material that is necessary in the catalyst only amounts to a few weight percent of the total catalyst weight. The balance of the catalyst weight consists of the catalyst support. Since the materials used for the catalyst support are much less expensive than the catalytically active materials, catalysts manufactured in this manner will have a much lower cost than those consisting of one hundred percent catalytically active material.

In addition to decreasing the catalyst cost, the use of this catalyst has another important feature. It allows the hydrocracking process to be carried out at lower pressures than have previously been possible. With conventional catalysts, higher pressures were required to inhibit the rate of formation of carbonaceous deposits on the catalyst surface. With the process according to the present invention, the catalyst particles are continuously swept out of the reactor vessel after a period of time while fresh catalyst particles are entering the reactor vessel continuously. As a result, the formation of minute amounts of coke on the catalyst surface is tolerable and so by lowering the total pressure, and therefore the hydrogen partial pressure, the somewhat larger quantity of coke formed on the catalyst is permissible. Thus, by the present invention it is possible to catalytically hydrocrack a heavy oil containing at least 25 weight percent of hydrocarbon substances which will boil at a temperature of at least 524° C., at least a portion of the hydrocarbon substances which will boil at a temperature of at least 524° C. containing hydrocarbon compounds which are coke forming and at least a portion of the hydrocarbon substances which boil at a temperature of at least 524° C. may contain metal or metals.

Examples of such heavy hydrocarbon oils are heavy crude oils, petroleum residua, bitumens from oil sand deposits and organic material from oil shale.

It was found that the quantity of the discrete mass that could be mixed with the feedstock could vary from 0.1 to 10 weight percent of the slurry, but is preferably in the range 0.3 and 3 weight percent.

Another important feature of the catalyst has been found to be its ability to remove foulants from the reaction system. When organometallic molecules in the heavy hydrocarbon oil are catalytically hydrocracked, the metals may deposit on the catalyst. Similarly, some of the hydrocarbon species in heavy hydrocarbon oil have a considerable tendency to form coke at hydrocracking reaction conditions. Coke will therefore also be formed at the reaction site on the catalyst. By continuously sweeping the catalyst particles out of the reactor vessel, the metal and coke foulants are continuously removed therefrom. This reduces the tendency for solid deposits to build up in the reaction system.

The same reaction conditions used to catalytically hydrocrack the heavy hydrocarbon oil also cause the coal or coke to be hydrogenated. The extent of hydrogenation is a function of the specific reaction conditions employed and of the nature of the coal or coke catalyst support particles. The net effect of the hydrogenation reaction is to produce liquids and gases from the coal or coke. The production of liquid products from the catalyst support is extremely desirable since it increases the quantity of useable fuels. One use for the gaseous products would be as a fuel for some of the plants used in the processing sequence.

TESTS TO VERIFY THE PRESENT INVENTION

EXAMPLE 1

(a) Materials

The bitumen used for the tests was obtained from Great Canadian Oil Sands Ltd. at Fort McMurray, Alberta using the so-called Clark hot water process to separate the coarse sand from the bitumen and then dilution centrifuging the bulk of the residual clay from the water-separated bitumen. The bitumen used for the tests was topped bitumen (diluent removed), typical of the material fed to a commercial delayed coking unit now in use. The general properties of the bitumen are shown in the following Table 1.

TABLE 1

| Properties of Athabasca Bitumen | |
|---|---|
| Specific Gravity 60/60° F. | 1.000 |
| Ash (wt %) 700° C. | 0.70 |
| Nickel (ppm) | 76 |
| Vanadium | 191 |
| Conradson Carbon Residue (wt %) | 12.6 |
| Pentane Insolubles (wt %) | 15.83 |
| Benzene Insolubles (wt %) | 0.90 |
| Carbon Disulphide Insolubles (wt %) | 0.88 |
| Sulfur (wt %) | 4.72 |
| Nitrogen (wt %) | 0.42 |
| Viscosity, Kinematic (cSt) at 210° F. | 129.5 |
| Viscosity, Kinematic (cSt) at 130° F. | 2041 |
| Molecular Weight (calculated) | 722 |
| Residuum (+975° F.) wt % | 51 |

The discrete catalyst supports were prepared from Star Key sub-bitumen C coal whose analysis is shown in the following Table 2. The composition of the catalyst expressed in the oxidized state was 1.2 wt % CoO, 2.4 wt % $MoO_3$, 16.4 wt % $Al_2O_3$ and 80 wt % coal.

TABLE 2

| Composition of Star Key Sub-bituminous C coal | |
|---|---|
| Proximate Analysis | wt % |
| moisture | 22.9 |
| volatile matter | 29.2 |
| ash | 11.4 |
| fixed carbon | 36.6 |
| Ultimate Analysis | wt % |
| carbon | 48.6 |
| hydrogen | 3.2 |
| nitrogen | 1.1 |
| sulphur | 0.3 |

(b) Apparatus and Operating Procedure

A standard bench-scale flow system designed to evaluate the catalyst performance was used. Hydrogen and bitumen at high pressure were combined and fed continuously into the bottom of a fixed-bed reactor vessel filled with a particulate mass comprising −4+8 mesh (U.S. Standare Sieve No.) catalyst particles. To begin the experiment the reactor vessel, filled with the catalyst particles, was pressurized at 500 psig and the hydrogen flow initiated. Approximately 1½ hours were required to bring the reactor vessel up to standard temperature and achieve steady-state conditions. The flow of bitumen to the reactor was begun as the coal temperature approached 250° C. The reaction mixture flowed up through the bed of catalyst particles where both bitumen hydrocracking and hydrogenation of the catalyst support (coal or coke) occurred. The reaction conditions are listed in the following Table 3:

TABLE 3

| Hydrocracking Reaction Conditions | |
|---|---|
| Temperature | 450° C. (732° K.) |
| Pressure | 500 psig |
| $H_2$ flowrate | 5000 scf/Bbl (0.0359 l/sec) |
| Bitumen flow rate (at 60° F.) | 153.6 ml/hr (42.7 ml/ks) |
| Liquid Space Velocity | 1.0 $hr^{-1}$ (0.28 $ks^{-1}$) |

The products flowed out of the top of the reactor vessel and were separated into liquid and vapour streams. The product was collected at standard conditions for three hours and then the reactor system was allowed to cool.

Variations in the quantity and quality of the products obtained when the above catalyst is used in the hydrocracking process are illustrated in FIGS. 1 to 3 as a function of temperature. All of the variables, except temperature were identical to those in Table 3. The yields are shown in FIG. 1 from which it will be seen that the quantity of unconverted pitch which boils above 524° C. decreases as the temperature increases. The quantity of distillate reaches a maximum at a reaction temperature near 450° C.

The quality of the liquid product obtained is illustrated in FIG. 2 from which it will be seen that the amount of metals (nickel, vanadium and iron) decreased considerably as the temperature increased. FIG. 3 shows that the tendency of the liquid product to form coke, as measured by the Conradson Carbon Residue, decreased as the reaction temperature increased. The sulphur content of the liquid product also decreased as the reaction temperature increased.

EXAMPLE 2

In order to further illustrate the characteristics of the catalyst in the hydrocracking process, tests were performed at a series of reactor vessel pressures. The results are shown in FIGS. 4, 5 and 6. The catalyst, reaction equipment and operation conditions used were the same as those described in EXAMPLE 1.

The product yields, shown in FIG. 4, only changed slightly as the reactor vessel pressure changed. The quantity of distillate was almost constant as a function of pressure. The quantity of unconverted pitch decreased as the pressure decreased. The amount of solids in the reactor vessel decreased as the pressure increased. This indicated that more coal was hydrogenated and less coke was formed from the bitumen at the higher reactor vessel pressures and therefore higher hydrogen partial pressures.

The quality of the liquid products also varied with pressure. The results in FIGS. 5 and 6 show that the metals (nickel, vanadium and iron) decreased, that the Conradson Carbon Residue decreased, and that the sulphur content decreased as the reactor pressure increased.

EXAMPLE 3

Tests for the quantity of catalytic ingredients required on the catalyst support were made in order to further define the characteristics of the hydrocracking process. The same catalyst support described in Example 1 was used. Different catalysts were made and their compositions are listed in the following Table 4. The reaction equipment and operating conditions used were the same as those described in Example 1.

TABLE 4

| | Catalyst Composition | | | | | |
|---|---|---|---|---|---|---|
| Wt % Catalytically Material | 20 | 10 | 5 | 1 | 0.2 | Nil |
| Wt % $Al_2O_3$ | 16.4 | 8.2 | 4.1 | 0.82 | 1.64 | Nil |
| Wt % $MoO_3$ | 2.4 | 1.2 | 0.6 | 0.12 | 0.24 | Nil |
| Wt % CoO | 1.2 | 0.6 | 0.3 | 0.06 | 0.12 | Nil |
| Wt % Coal | 80 | 90 | 95 | 99 | 99.8 | 100 |

The product yields are shown in FIG. 7 from which it will be seen that there is essentially no change in any of the yields as the quantity of active catalyst material on the support is decreased from 20 to 1 weight percent. Changes did occur when the quantity of catalyst material on the support was decreased below 1 weight percent. For example when there was no active catalyst material on the support, the yield on unconverted pitch was 20.6 wt percent. This was essentially twice as much as was obtained when the catalyst was present.

The quality of the products is shown in FIGS. 8 and 9. The metals (nickel, vanadium and iron) and Conradson Carbon Residue did not change significantly as the amount of catalyst material on the support was decreased from 20 to 1 weight percent, however, the sulphur content did change significantly.

As long as sufficient active catalyst material is used, so that a surface layer completely covering the exterior of the support particle can be formed, no significant change in yields or product qualities can be expected except for the observed sulphur content. The results shown indicate that with the exception of the sulphur content, even 1 weight percent of the catalyst material on the support is adequate.

EXAMPLE 4

(a) Materials

The bitumen feedstock was the same as that described in Example 1 and had the properties listed in Table 1. The properties of the catalyst support are listed in the following Table 5. The composition of the catalyst, expressed in the oxidized state was 0.6 wt % CoO, 1.2 wt % $MoO_3$, 8.2 wt % $Al_2O_3$ and 90 wt % coal. The catalyst mass was −200 mesh particle size.

TABLE 5

Composition of Whitewood Sub-bituminous B Coal

| Proximate Analysis | wt % |
|---|---|
| moisture | 17.6 |
| volatile matter | 30.6 |
| ash | 10.7 |
| fixed carbon | 41.1 |
| **Ultimate Analysis** | **wt %** |
| carbon | 52.5 |
| hydrogen | 3.6 |
| nitrogen | 0.7 |
| sulphur | 0.2 |

(b) Apparatus and Operating Procedure

These tests were performed in a continuous operation at steady state conditions. The fine catalyst particles were mixed with the bitumen to form a bitumen-catalyst slurry. The slurry was maintained slightly above ambient temperature in an agitated feed tank from which it entered the slurry pump suction line. After leaving the slurry pump discharge port, the slurry was mixed with high pressure hydrogen and the mixture flowed into the bottom of a tubular reactor vessel. The tubular reactor vessel was maintained at conditions similar to those listed in Table 3, except that a pressure of 2000 psig was used. Both bitumen hydrocracking and hydrogenation of the catalyst support (coal) occurred in the reactor. One phenomenon of great interest was that the large number of catalyst particles in the reactor vessel presented a large solid surface area on which both coke and metals could deposit. The reaction mixture left the reactor vessel at the top and the vapour was subsequently separated from the liquid and the solids. Approximately 1½ hours were required to establish standard operating conditions in the reactor vessel. The bitumen and the hydrogen flowed through the reactor vessel during the startup period. After the desired operating conditions had been attained, steady state conditions were maintained for an extended period of time. At the conclusion of the experiments the reactor vessel was cooled to ambient conditions and drained.

Following the shut down procedure and reactor vessel was opened and visually inspected in order to determine whether or not deposits of coke or other reaction by-products had been deposited within its interior.

These experiments were performed for an extended period of time. All of the yields and product qualities were essentially constant throughout the operating period. As an example, the weight percent sulphur in the liquid product remained substantially constant at about 2.5% over an operating period of 70 hours. At the conclusion of the extended experiment, the reactor was opened and inspected. The interior was clean and no trace of reactor by-products, coke or any foulant was evident.

While compounds of cobalt and molybdenum are preferred any compounds of metals of Groups VI (b) and VIII of the Periodic Table of Elements given in the Handbook of Chemistry and Physics, published by CRC Press, 45th edition, 1973–1974, may be used.

We claim:

1. A process for catalytically hydrocracking a heavy hydrocarbon oil, comprising, (a) heating the heavy hydrocarbon oil to a temperature in the range 50° C. to 400° C., then (b) mixing the heavy hydrocarbon oil, while at the temperature in the range 50° C. to 400° C., with a particulate catalyst mass to form a slurry, the particulate catalyst mass being in the range 0.1 to 10 weight percent of the slurry and comprising discrete catalyst supports of at least one material selected from the group consisting of coal and coke with each catalyst support coated with a catalytically active aluminum compound and at least one catalytically active material selected from the group consisting of compounds of metals of Group VI (b) and Group VIII of the Periodic Table of Elements, (c) mixing the slurry with hydrogen gas and heating the mixture to a temperature in the range 250° C. to 550° C., then (d) continuously feeding the mixture while at the temperature in the range 250° C. to 550° C. to a lower end portion of a catalytic hydrocracking reactor vessel, (e) causing the mixture to flow upwardly in the reactor vessel at a pressure in the range 100 to 3,500 psig and at a temperature in the range 400° C. to 500° C. so that gaseous and vapour phase components liberated from the mixture in the reactor vessel rise rapidly therein and separate from residual liquid phase and entrained particulate solids components which flow slowly upwardly therein, and (f) continuously withdrawing the gaseous and vapour phase components and the liquid phase with entrained particulate solids from an upper portion of the reactor vessel.

2. A process according to claim 1, wherein the steps (a) and (b) are carried out at a temperature in the range 75° C. to 125° C., the steps (c) and (d) are carried out at a temperature in the range 375° C. to 475° C., and the step (e) is carried out at a pressure in the range 500 to 2,000 psig and at a temperature in the range 425° C. to 475° C.

3. A process according to claim 1, which includes producing the particulate catalyst mass by preparing a gel mixture of the catalytically active material comprising alpha alumina monohydrate (boehmite), ammonium paramolybdate, cobalt nitrate and water, the composition of the gel expressed in terms of oxides of the metal catalysts being 1 to 11 weight percent CoO, 4 to 18 weight percent $MoO_3$ and 71 to 96 weight percent $Al_2O_3$, mixing the gel with water and the discrete catalyst bodies, then heating and continuously stirring the mixture until the excess liquid had evaporated, then drying and the particulate catalyst mass thus produced.

4. A process according to claim 3, wherein the composition of the gel expressed in terms of oxides of the catalyst metals is 3 to 9 weight percent CoO, 9 to 15 weight percent $MoO_3$ and 76 to 93 weight percent $Al_2O_3$.

5. A process according to claim 1, wherein the particulate catalyst mass is in the range 0.3 to 3 weight percent of the slurry.

6. A process according to claim 1, wherein the catalytically active material comprises at least 1 weight percent on each discrete catalyst support.

7. A process according to claim 1, wherein the compounds of metals selected from group consisting of compounds of metals of Group VI (b) and Group VIII are compounds of molybdenum and tungsten respectively.

* * * * *